US005205772A

United States Patent [19]

Kennard et al.

[11] Patent Number: 5,205,772

[45] Date of Patent: Apr. 27, 1993

[54] SEGMENTED TOY HOUSE CONSTRUCTION

[76] Inventors: Amy M. Kennard; James R. Kennard, both of 114 Country Club Dr., Lansdale, Pa. 19446

[21] Appl. No.: 823,388

[22] Filed: Jan. 21, 1992

[51] Int. Cl.[5] ..... A63H 33/00

[52] U.S. Cl. ..... 446/124; 446/108; 446/476

[58] Field of Search ..... 446/108, 111, 119, 476, 446/124, 125, 126, 118, 107

[56] References Cited

U.S. PATENT DOCUMENTS

| | | | |
|---|---|---|---|
| 2,825,178 | 3/1958 | Hawkins | 446/119 |
| 2,861,388 | 11/1958 | Favaretto | 446/119 X |
| 3,222,072 | 12/1965 | Dreyer | 446/119 X |
| 3,672,681 | 6/1972 | Wolf | 446/119 X |
| 4,232,473 | 11/1980 | Jenkins | 446/119 X |

*Primary Examiner*—Robert A. Hafer

*Assistant Examiner*—Sam Rimell

*Attorney, Agent, or Firm*—Hugh E. Smith

[57] ABSTRACT

A toy house configured for construction to include a plurality of segmented members interfitting relative to one another to effect an erected structure. The segments include interfitting components provided with projections and recesses for interfitting relative to one another. The housing members are each arranged to be subsequently provided with adequate information relative to the historical period of the housing member to include culture, music, available food, and the like. Modified segment members are arranged to be formed with through-extending conduits projecting through opposed end walls, wherein the end walls are arranged in a parallel relationship and wherein at least one spinal member is arranged for projecting through at least one of said conduits to permit deforming of the conduit into a predetermined configuration for construction of a predetermined housing type.

2 Claims, 5 Drawing Sheets

SEGMENTED TOY HOUSE CONSTRUCTION

BACKGROUND OF THE INVENTION

1. Field of the Invention

The field of invention relates to toy housing apparatus, and more particularly pertains to a new and improved segmented toy house construction wherein the same is arranged to be formed of a plurality of intercommunicating segments.

2. Description of the Prior Art

Various toy house construction arranged for subsequent erection and dismantling are available in the prior art, but the prior art has heretofore not availed itself of historically associating various segmented house members relative to historical time frames. Such prior art toy house construction is exemplified in U.S. Pat. No. 4,107,869 to Abrams; U.S. Pat. No. 4,602,908 to Kroever; U.S. Pat. No. 3,719,003 to Skjoldborg; and U.S. Pat. No. 3,949,516 to Jronert.

Accordingly, it may be appreciated that there continues to be a need for a new and improved segmented toy house construction as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of toy house construction now present in the prior art, the present invention provides a segmented toy house construction wherein the same utilizes intercommunicating segmented components arranged for securement relative to one another to provide for an erected structure consistent with an historical time frame. As such, the general purpose of the present invention, which will be described subsequently in greater detail, is to provide a new and improved segmented toy house construction which has all the advantages of the prior art toy house construction and none of the disadvantages.

To attain this, the present invention provides a toy house configured for construction to include a plurality of segmented members interfitting relative to one another to effect an erected structure. The segments include interfitting components provided with projections and recesses for interfitting relative to one another. The housing members are each arranged to be subsequently provided with adequate information relative to the historical period of the housing member to include culture, music, available food, and the like. Modified segment members are arranged to be formed with through extending conduits projecting through opposed end walls, wherein the end walls are arranged in a parallel relationship and wherein at least one spinal member is arranged for projecting through at east one of said conduits to permit deforming of the conduit into a predetermined configuration for construction of a predetermined housing type.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved segmented toy house construction which has all the advantages of the prior art toy house construction and none of the disadvantages.

It is another object of the present invention to provide a new and improved segmented toy house construction which may be easily and efficiently manufactured and marketed.

It is a further object of the present invention to provide a new and improved segmented toy house construction which is of a durable and reliable construction.

An even further object of the present invention is to provide a new and improved segmented toy house construction which is susceptible of a low cost of manufacture with regard to both materials and labor, and which accordingly is then susceptible of low prices of sale to the consuming public, thereby making such segmented toy house construction economically available to the buying public.

Still yet another object of the present invention is to provide a new and improved segmented toy house construction which provides in the apparatuses and methods of the prior art some of the advantages thereof while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
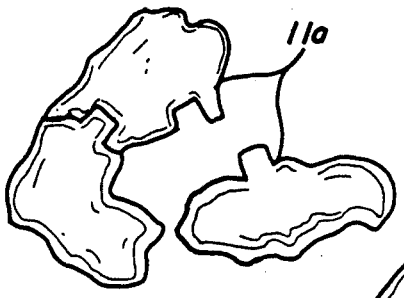
FIG. 1 is an orthographic view of a plurality of first segment members.

With reference now to the drawings, and in particular to FIGS. 1 to 16 thereof, a new and improved segmented toy house construction embodying the principles and concepts of the present invention and generally designated by the reference numerals 11-26 will be described.

Figure 2:
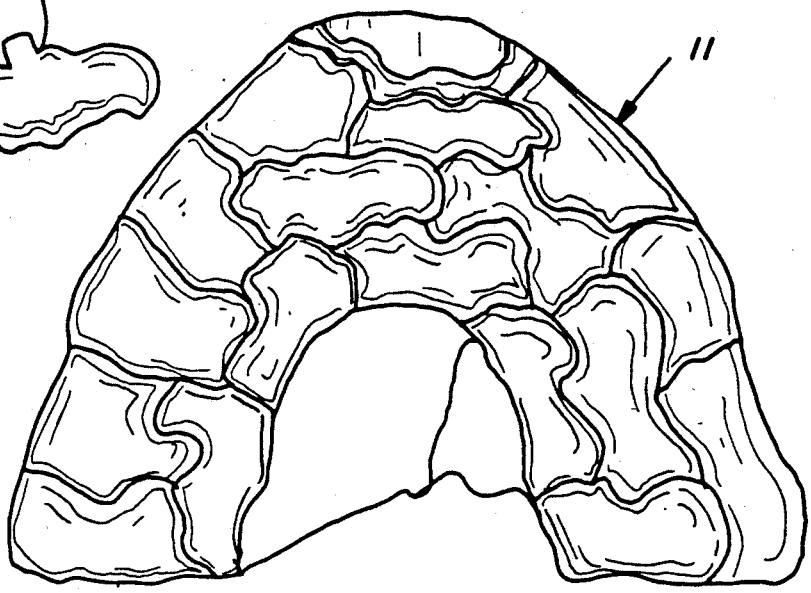
FIG. 2 is an isometric illustration of a first dwelling type.
Figure 3:
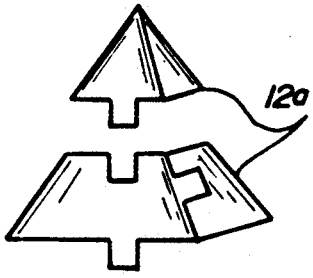
FIG. 3 is an isometric illustration of a second segment type.
Figure 4:
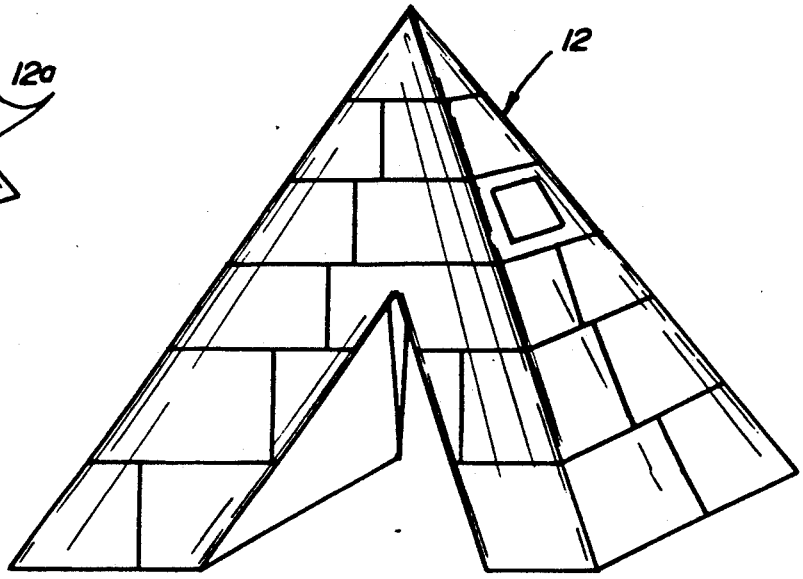
FIG. 4 is an isometric illustration of a pyramid type construction.
Figure 5:
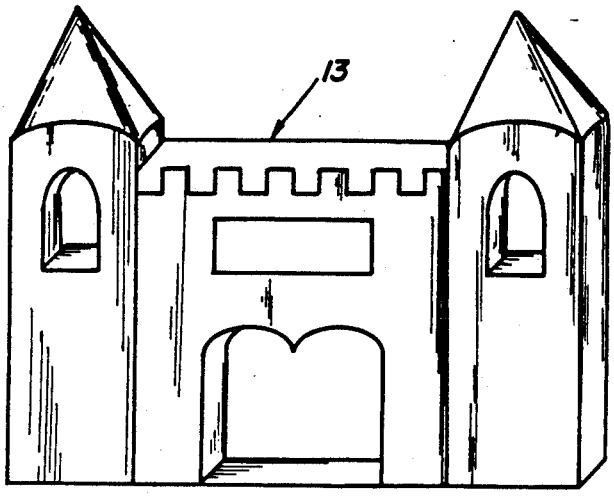
FIG. 5 is an isometric illustration of a castle type dwelling.
Figure 6:
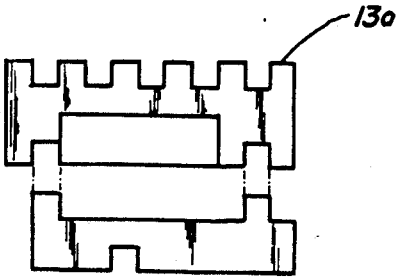
FIG. 6 is an orthographic view of third segment members utilized in the construction of the dwelling of FIG. 5.
Figure 7:
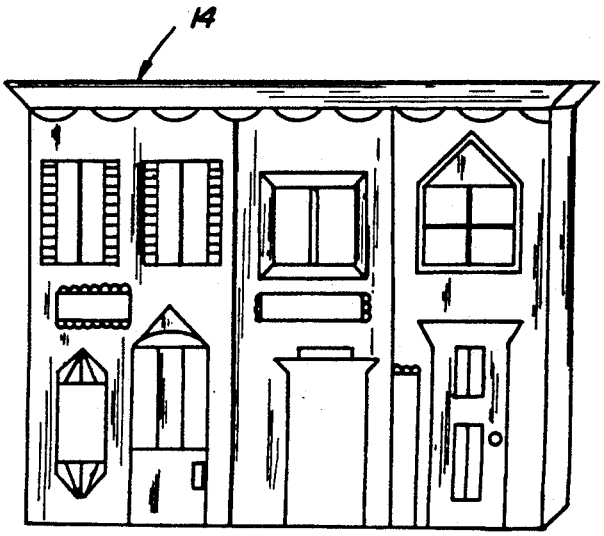
FIG. 7 is an isometric illustration of a Victorian type dwelling.
Figure 8:
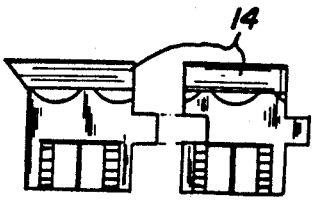
FIG. 8 is an orthographic view of fourth segment members utilized in the construction of the invention, as set forth in FIG. 7.
Figure 9:
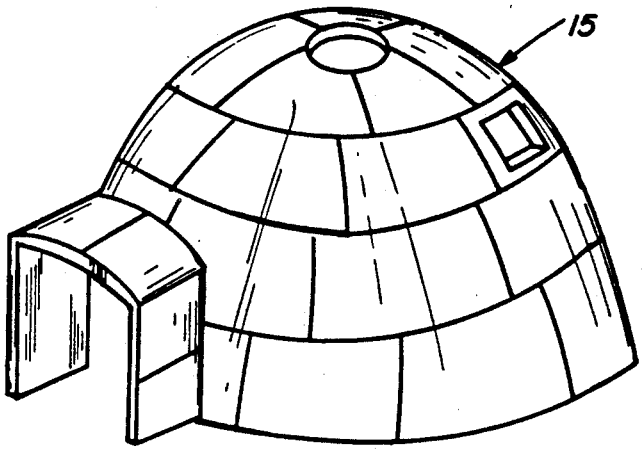
FIG. 9 is an isometric illustration of an igloo type dwelling.
Figure 10:
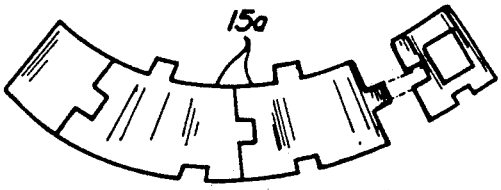
FIG. 10 is a top orthographic view of fifth segment members utilized in construction of the igloo of FIG. 9.
Figure 12:
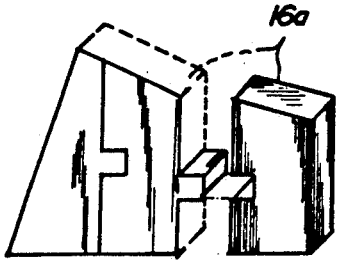
FIG. 12 is an isometric illustration of sixth type segments utilized in the construction of the dwelling, as set forth in FIG. 11.
Figure 11:
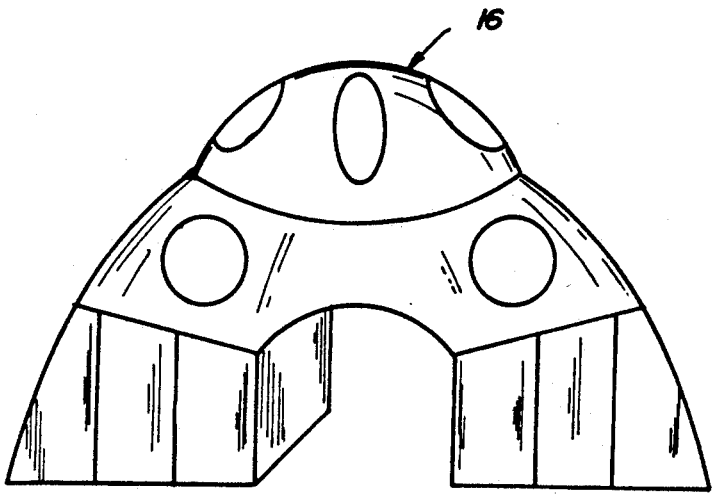
FIG. 11 is an isometric illustration of a futuristic type dwelling.

More specifically, the segmented toy house construction of the invention essentially comprises the construction of various housing members to include a cave-like housing 11 as set forth in FIG. 2, a pyramid housing 12 as set forth in FIG. 4, a castle housing 13 as set forth in FIG. 5, a Victorian housing 14 as set forth in FIG. 7, an igloo housing as set forth in the FIG. 9, and a futuristic type dwelling as set forth in FIG. 11. The use of respective first, second, third, fourth, and fifth segments 11*a*, 12*a*, 13*a*, 14*a*, 15*a*, and 16*a* are arranged in the respective construction of the housings of FIGS. 2, 4, 5, 7, 9, and 11. It is contemplated that the dwellings be accompanied in educational format to include a book or cassette for historical and technical information regarding an associated time frame relative to a particular dwelling type and character. Further, such information would include types of food, clothing, as well as music to be provided by cassette tape (not shown).

The segments are of an inter-relationship relative to one another to be complimentarily configured relative to one another for their construction to a final erected structure of a type as illustrated in the Figures. Various of the segments could include through-extending openings to function as windows for access interiorly of each housing type.

Figure 13:
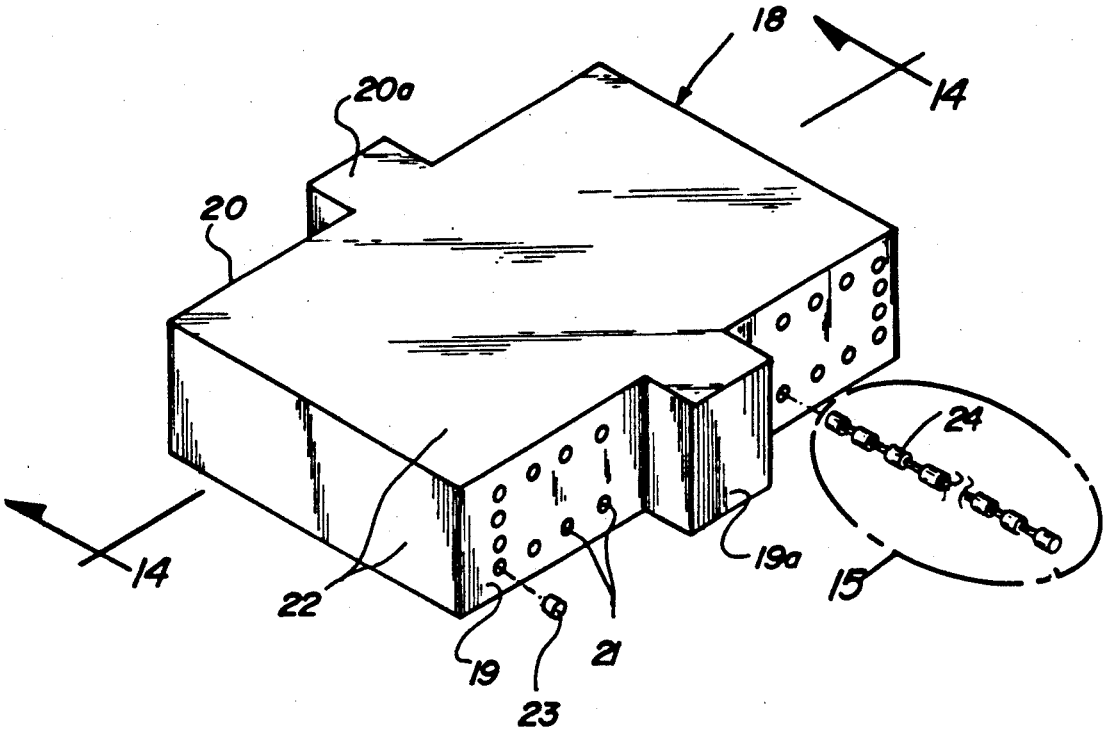
FIG. 13 is an isometric illustration of modified segment members utilized in universal application to the dwelling structure of the FIGS. 2, 4, 5, 7, 9, and 11.
Figure 14:
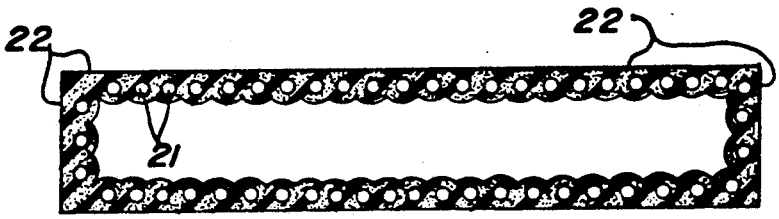
FIG. 14 is an orthographic view, taken along the lines 14—14 of FIG. 13 the direction indicated by the arrows.
Figure 15:
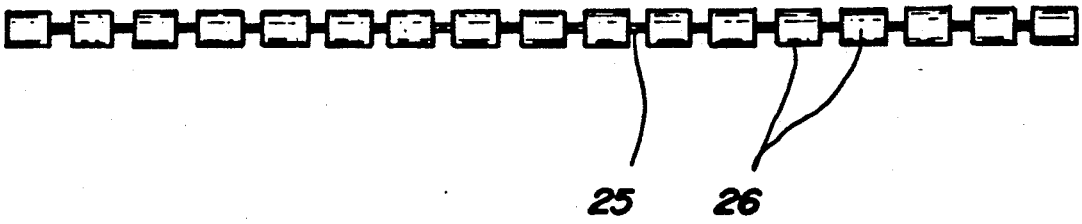
FIG. 15 is an orthographic view of section 15 as set forth in FIG. 13.
Figure 16:
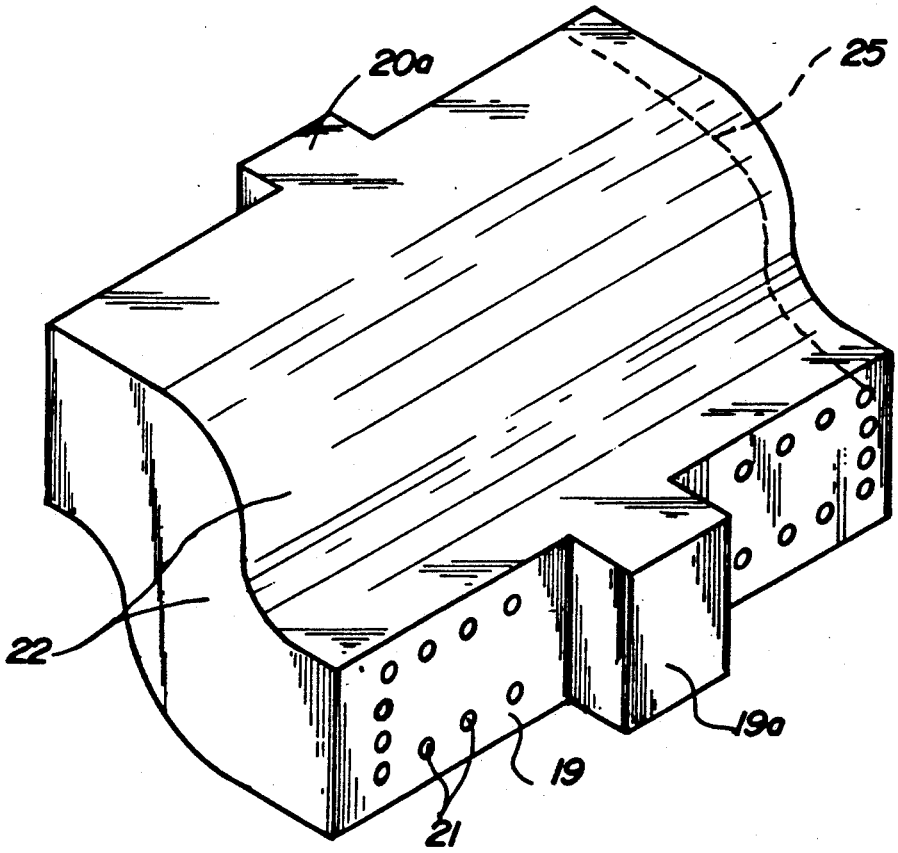
FIG. 16 is an isometric illustration of the modified segment member in a deformed configuration.

The use of various segments may of rigid construction or as illustrated in the FIGS. 13-16, of a malleable type of each unit being deformable. The modified segments 18 are illustrated in FIG. 13 that include respective parallel first and second end walls 19 and 20 that include respective first and second projections 19*a* and 20*a*. It should be understood that in lieu of such projections, receiving cavities may be provided of a type as illustrated in the FIG. 3 for example to provide for inter-relationship of the segments. The segments are further provided with a continuous side wall 21 between the end walls. The end walls include a matrix of through-extending conduits 21 that are arranged in a parallel relationship relative to one another projecting from the first end wall 19 to the second end wall 20. Various plug members 23 may be provided to effect plugging of selective conduits not desired for use, Wherein at least one spinal member 24, and preferably a plurality of such spinal members 24, are provided and projected through at least one of the conduits 21. The spacing from the first end wall 19 to the second end wall 20 is of a predetermined length, wherein each spinal member 24 is of a length substantially equal to the predetermined length to interfit between the end walls. Each spinal member 24 includes a deformable wire spine 25 positioned coaxially of a plurality of spaced cylindrical segments 26 that function as spacers, but yet minimize frictional engagement of each spinal member 24 within a respective conduit 21. In this manner, the modified segment unit 18 may be deformed in a manner as set forth in FIG. 6, with the spinal member 24, and more specifically the deformable wire spine 25, deformed into a desired configuration to thereby permit children, as well as other individuals, to configure the segments for utilization of imagination in construction of various dwelling units in a departure from the types as illustrated in the FIGS. 2 and 4 for example utilizing the segments in a preconfigured interrelationship relative to one another.

It should be further noted that each segment unit 18 is formed of a polymeric foam construction to include a central cavity between the end walls and the surrounding side wall to more readily accommodate deformation of each segment unit in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A segmented toy house construction, comprising, a housing, the housing including a plurality of segment members in interfitting communication relative to one another, wherein each segment is of a complementary configuration relative to an adjacent segment. and each segment includes a first end wall spaced from and parallel a second end wall, and a plurality of conduits extend coextensively between the first end wall and the second end wall, with a continuous side wall extending between the first end wall and the second end wall, and at least one spinal member arranged for projection into at least one of said conduits, and a predetermine spacing is defined between the first end wall and the second end wall defined by a predetermined length, wherein each spinal member is of a spinal member length substantially equal to the predetermined length, and wherein each spinal member includes a plurality of spaced cylindrical segments, the cylindrical segments complimentarily received into said at least one of said conduits, and a deformable wire spine coaxially directed through each of the cylindrical segments to permit selected deformation of the segment upon deformation of the deformable wire spine.

2. A segmented toy house as set forth in claim 1 wherein each segment is formed of a hollow deformable polymeric foam.

* * * * *